US005595031A

United States Patent [19]

Commins

[11] Patent Number: 5,595,031

[45] Date of Patent: Jan. 21, 1997

[54] ONE-PIECE, IN-LINE SHEET METAL HOLDOWN STRAP CONNECTOR

[75] Inventor: Alfred D. Commins, Danville, Calif.,

[73] Assignee: Simpson Strong-Tie Company, Inc., Pleasanton, Calif.;

[21] Appl. No.: 297,585

[22] Filed: Aug. 29, 1994

(Under 37 CFR 1.47)

[51] Int. Cl.[6] ..... E02D 27/02; E04B 1/38

[52] U.S. Cl. ..... 52/264; 52/105; 52/295; 52/699; 52/712

[58] Field of Search ..... 52/264, 295, 105, 52/699, 712, 169.9, 274, 293.1, 293.3, 714

[56] References Cited

U.S. PATENT DOCUMENTS

| | | | |
|---|---|---|---|
| 3,334,465 | 8/1967 | Hoffmann, Jr. | 52/105 X |
| 3,998,026 | 12/1976 | Allen | 52/295 X |
| 4,202,149 | 5/1980 | Betrue, Sr. | 52/699 |
| 4,404,781 | 9/1983 | Gilb | 52/295 |
| 4,570,403 | 2/1986 | Dannemiller | 52/295 |
| 4,739,598 | 4/1988 | Jensen et al. | 52/295 |
| 4,841,690 | 6/1989 | Commins | 52/105 |
| 4,896,985 | 1/1990 | Commins | 52/712 X |
| 5,150,553 | 9/1992 | Commins et al. . | |
| 5,249,404 | 10/1993 | Leek et al. . | |
| 5,390,455 | 2/1995 | Antolini | 52/295 X |

OTHER PUBLICATIONS

Simpson Strong–Tie Co., Inc. catalog "Connectors for Wood Construction catalog C–94H–1", p. 19.

*Primary Examiner*—Carl D. Friedman
*Assistant Examiner*—Kevin D. Wilkens
*Attorney, Agent, or Firm*—James R. Cypher

[57] ABSTRACT

A holdown strap connection including a sheet metal holdown strap connector for joining a generally vertical frame member such as a post or stud to a concrete foundation made from one piece of sheet metal that installs easily to otherwise identical left and right corner vertical frame members with the same load values for resistance to uplift forces. The one-piece, in-line sheet metal holdown strap connector includes a foot section embedded in the concrete, a transition section connected to the foot section and an elongated strap section integrally connected to the transition section that extends in registration with the side face of a vertical frame member and attaches thereto.

6 Claims, 8 Drawing Sheets

EMB
EMB

ONE-PIECE, IN-LINE SHEET METAL HOLDOWN STRAP CONNECTOR

BACKGROUND

This invention relates to a connection, including a single-piece, in-line sheet metal holdown strap connector, for attaching the vertical frame member of a structure to a concrete foundation.

Earthquakes, hurricanes, tornadoes, floods, or tidal action impose upward forces on a building structure that can lift it off its foundation. To counteract these uplift forces, it has become standard practice to tie the structure to its concrete foundation. The oldest and probably still the most common practice of making this connection is to attach the framed structure to threaded anchor bolts embedded in the concrete foundation. How the connection is made to the framed structure is important in determining the resistance of the connection to uplift forces. The threaded anchor bolt can attach to the framed structure at the mudsill member of the framed structure, however, the connection is more effective if the anchor member is attached directly to the vertical frame members or studs of the structure.

One approach adopted by prior art for connecting the embedded anchor to the vertical frame members has been to use a separate metal holdown connector to connect the threaded anchor to the vertical frame member. U.S. Pat. No. 5,249,404, granted Oct. 5, 1993 to William F. Leek and Alfred D. Commins, represents the state of the art of a connection between a concrete structure and a vertical frame member, using a threaded anchor bolt and a separate metal holdown connector. Adding a metal holdown connector integrated well with the existing method of tying the threaded anchor bolt to a mudsill, however, the use of multiple parts for the connection is both labor intensive and relatively expensive.

Also, metal holdowns used in these connections must be designed to resist the moment force of the uplift force that is inherent in their design. The attachment interface of the metal holdown to the vertical frame member and the attachment interface of the metal holdown connector to the threaded anchor bolt are not substantially in line, thus the uplift force exerted on the connection also has a significant moment force that the metal holdown connector must bear.

Another approach in the prior art to making this connection is represented by disclosures of holdown strap connectors. In this method, the threaded anchor bolt is replaced by an embedded strap that passes around the outside of the mudsill member rather than through it, and attaches only at the vertical frame member. U.S. Pat. No. 5, 150,553, granted Sep. 29, 1992 to Alfred D. Commins and Ernest A. Romeo represents the state of the art of a connection between a concrete structure and a vertical frame member with a holdown anchor strap connector. Anchor straps are relatively inexpensive both in terms of material costs and installation costs and are thus attractive to developers and builders. Because anchor straps circumvent the mudsill rather than going through it to attach to the vertical frame member, the step of drilling the mudsill is eliminated. However, by going around the mudsill (usually on the outside), the anchor strap can interfere with other steps in the building process, such as the attachment of side paneling or plywood shear walls. U.S. Pat. No. 5,150,553 improved on prior anchor straps by attaching to the side face of the vertical frame member rather than to its outside edge. Attaching to the side face left more of the outside edge of the vertical frame member exposed and available for the attachment of siding or plywood shear wall panels. Attaching to the side face also allows fasteners to penetrate the wide face of the vertical frame member thus reducing splitting when wood frame members or studs are used. However, with anchor strap connectors an issue that was relatively minor for connections using threaded anchor bolts becomes very important, and that is proper placement of the embedded portion for insuring the achievement of the necessary design resistance load values.

The resistance of embedded anchors in concrete to uplift forces decreases as the anchor's distance from the sides and edge of the concrete structure decreases. Thus, maximizing the concrete surrounding the anchor will increase the anchor's resistance to uplift forces.

Current methods of building framed structure limit the options a connection designer has for increasing the horizontal distance between the anchor and the outer or inner side faces of a typical 6" concrete stem wall. Generally, the mudsill member is placed so that its outside edge is flush with the outside edge of the concrete foundation. A threaded anchor bolt that pierces this mudsill should thus be placed near the center of the mudsill member to increase its hold on the member. An anchor strap that goes around the outside of the mudsill is similarly limited in where it can protrude from the concrete structure in relation to the horizontal distance from the outside edge.

When the vertical frame member to be anchored forms part of a corner or the end of a shear wall then the distance from the embedded anchor to this corner edge becomes important. Under current practice, a threaded anchor bolt will always have at least the width of the vertical frame member between itself and the corner edge of the concrete. Anchor straps that attach to the outside face of vertical frame member, however, have no similar minimum distance for this measurement determined by the design of the shear wall to which the anchor will attach. Were a builder to disregard the need to maximize this distance between the corner edge of the concrete structure and the anchor strap connector by placing the edge of the anchor strap connector at the edge of the concrete foundation the practical utility of the anchor strap connector would be largely defeated. It should also be noted that anchor strap connectors that attach to the outside edge of the vertical frame member can never be very far from the corner edge of the concrete foundation, since they commonly use much of the width of the outside edge of the vertical framing member for attachment. In comparison, the prior art's anchor strap connectors that attach to the side face of vertical frame member have at least the width of the vertical frame member between the attachment portion of the anchor strap connector and the corner edge, however, depending on the design of the anchor strap connector, the distance from the embedded portion of the anchor strap connector to the corner edge can be more or less than this distance. With certain designs of anchor strap connector that attach to the side face of the vertical frame member this distance also depends on the chirality of the corner where the anchor strap connector is placed.

For example, the one-piece version of U.S. Pat. No. 5,150,553 has different load capacities at otherwise uniform left and right corners, because of the different orientation of the embedded strap portion to the side face of the vertical frame member and thus to the corner edge of the concrete foundation as well. This problem is solved by making and using both right and left chiral versions of the one-piece design. However, having both right and left forms is confusing for the builder, and means added manufacturing costs.

On the other hand, the two-piece version of U.S. Pat. No. 5,150,553 attaches to a vertical framing member at similarly designed left or right corners with generally the same distance between the near edge of the embedded portion of the anchor strap connector and the corner edge of the concrete foundation. Thus if standard construction practices are used and the directions for installation are followed, the distance between the embedded portion of the anchor strap connector and corner edge, depends only upon the design of the vertical frame member that constitute the corner or edge. However, instructions for the installation of the two-piece connector of U.S. Pat. No. 5,150,553 are relatively complicated. Also the two-piece design that allows for similar placement at right and left corners uses an elongated strap portion with tabs that protrude past the outside edge of the vertical frame member. When plywood shear walls are attached over the two-piece connector of U.S. Pat. No. 5,150,553 there is greater bulging of the plywood then when the one-piece version is used.

Both versions of U.S. Pat. No. 5,150,553 suffer from complicated requirements for their placement in the concrete foundation. The builder pouring the concrete foundation and setting the holdown anchor strap connector needs to first mark where the side face of the vertical member will be on the concrete form board. He then attaches the holdown strap connector to the concrete form board to the left or right of this mark a selected distance based on his knowledge of whether the embedded strap portion and transition member is to be substantially to the left or right of the side face of the vertical frame member. With the one-piece version of U.S. Pat. No. 5,150,553 the builder must also keep track of which chiral version of the holdown strap connector is to be used. Proper placement is thus dependent on the builder not only knowing where the side face of vertical frame member will be, but the orientation of the holdown strap connector to that side face.

The one-piece version of U.S. Pat. No. 5,150,553 also does not achieve substantial alignment of the connections between the vertical frame member and the concrete foundation, thus the uplift force exerted on the connection has a significant moment force that the metal holdown connector must bear.

SUMMARY OF THE INVENTION

An object of the present invention is to provide a one-piece holdown strap for connecting a vertical frame member such as a stud or post to a concrete foundation which does not require the presetting of a threaded anchor in the concrete foundation.

Another object is to provide a one-piece holdown strap connector which attaches to the side of the vertical frame member instead of the outside edge of the vertical frame member.

Another object is to provide a one-piece holdown strap connector which can be installed at identical corners having opposite chirality and still provide identical resistance to uplift forces.

Another object is to provide a one-piece holdown strap connector which keeps uplift forces exerted on the holdown strap connector in as close a straight line as possible to reduce the moment of the uplift force, while minimizing the use of raw materials.

Another object is to provide a one-piece holdown strap connector which is dimensioned so that when it is attached to the side face of a standard wood vertical frame member splitting of the stud due to the insertion of fasteners will be minimized.

Another object is to provide a one-piece sheet metal holdown strap connector which can be made as a single blank formed from a roll of steel on a continuous die cutting machine.

Another object is to provide a one-piece sheet metal holdown strap connector which interferes minimally with the attachment of members to the outside faces of a framed structure.

Still another object is to provide a holdown strap connector which can be set at the appropriate place in a concrete foundation that is to be poured by aligning the center of the holdown strap connector with a mark representing the side face of the vertical frame member to which the holdown strap connector will attach.

DESCRIPTION

Figure 1:
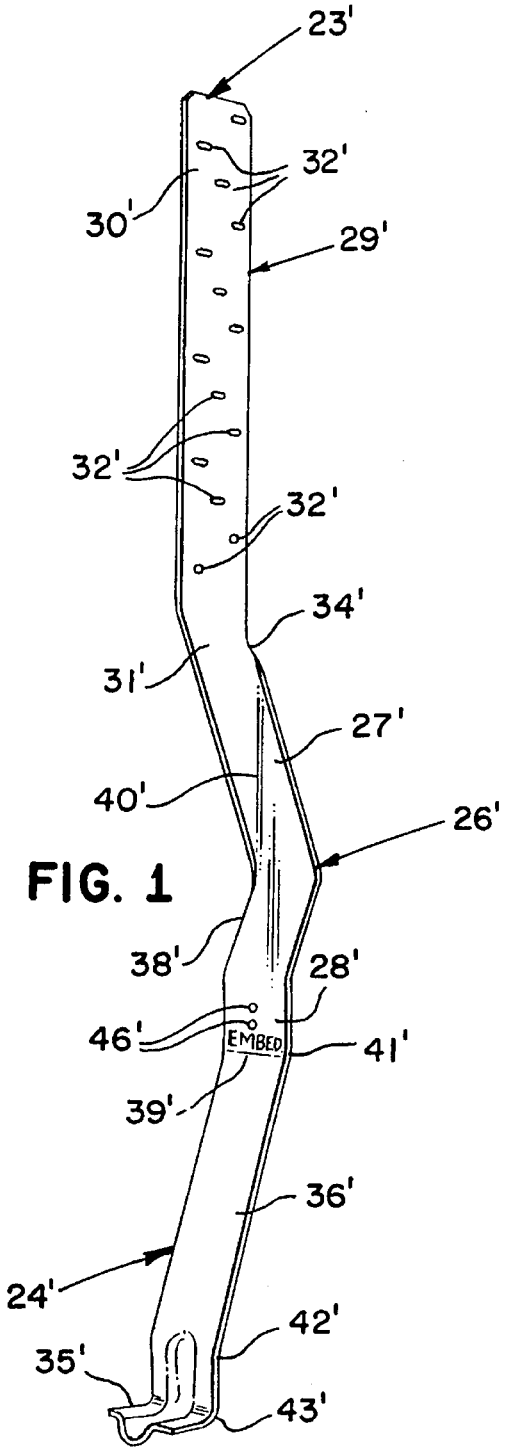
FIG. 1 is a perspective view of one form of the one-piece, in-line sheet metal holdown strap connector of the present invention.
Figure 2:
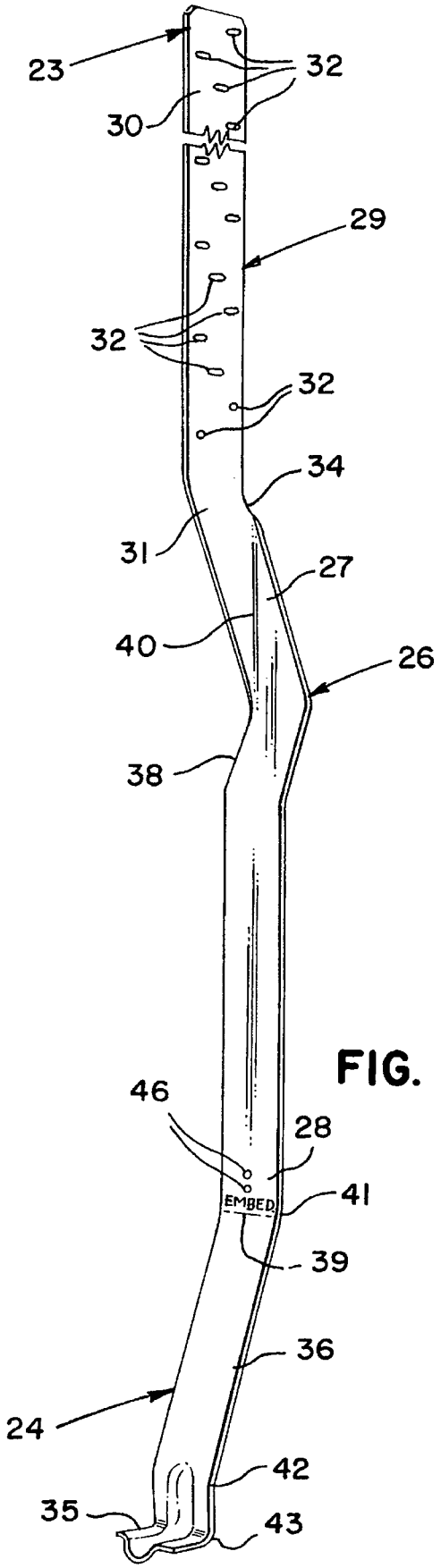
FIG. 2 is a perspective view of another form of the one-piece, in-line sheet metal holdown strap connector of the present invention.
Figure 3:
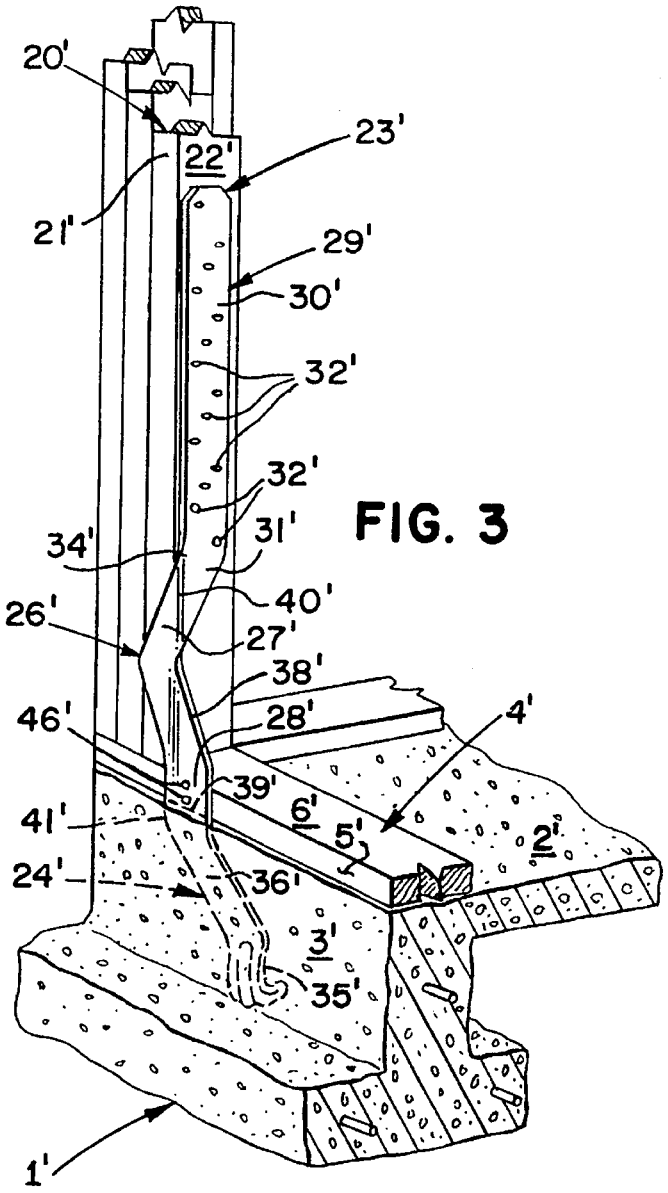
FIG. 3 is a perspective view of one form of the holdown strap connection, including a concrete foundation, a mudsill member and a vertical frame member. The holdown strap connection is shown at a triple 2B left corner with a slab on grade foundation. Only a portion of the vertical frame members are shown. Dashed lines show the foot section of the one-piece, in line sheet metal holdown strap connector embedded in the concrete foundation.
Figure 4:
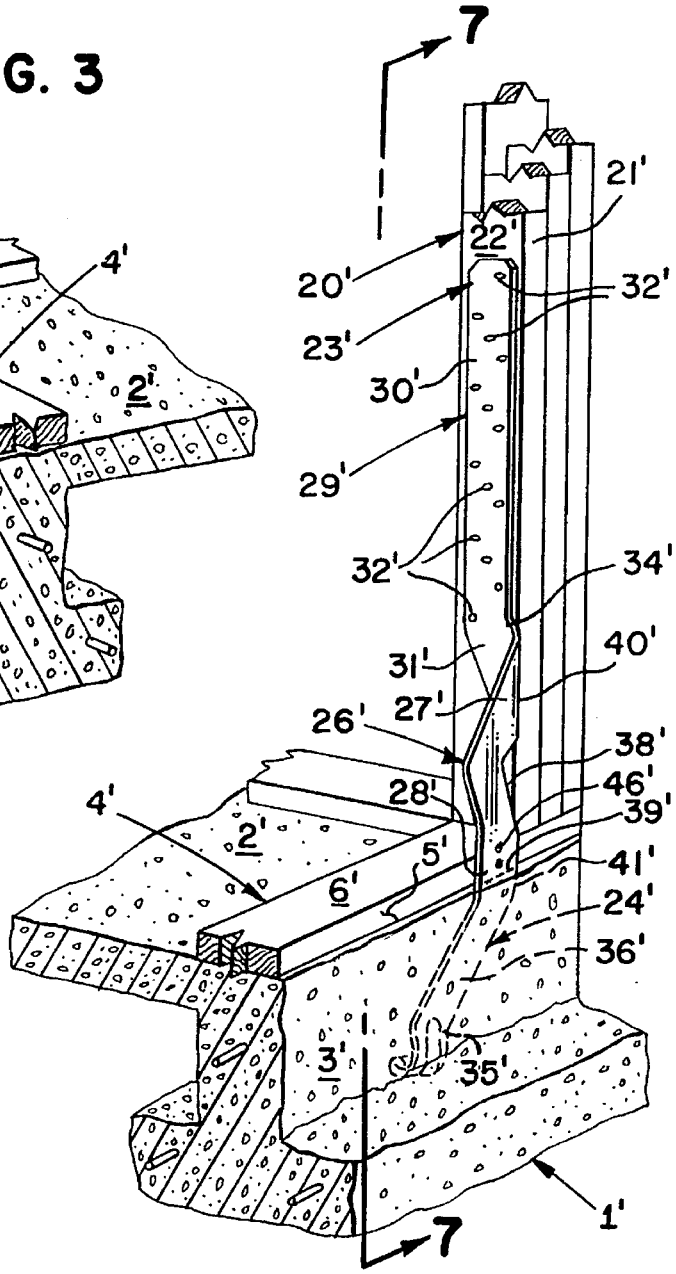
FIG.4 is a perspective view of one form of the holdown strap connection, including a concrete foundation, a mudsill member and a vertical frame member. The holdown strap connection is shown at a triple 2x right corner with a slab on grade foundation. Only a portion of the vertical frame members are shown. Dashed lines show the foot section of the one-piece, in line sheet metal holdown strap connector embedded in the concrete foundation.
Figure 5:
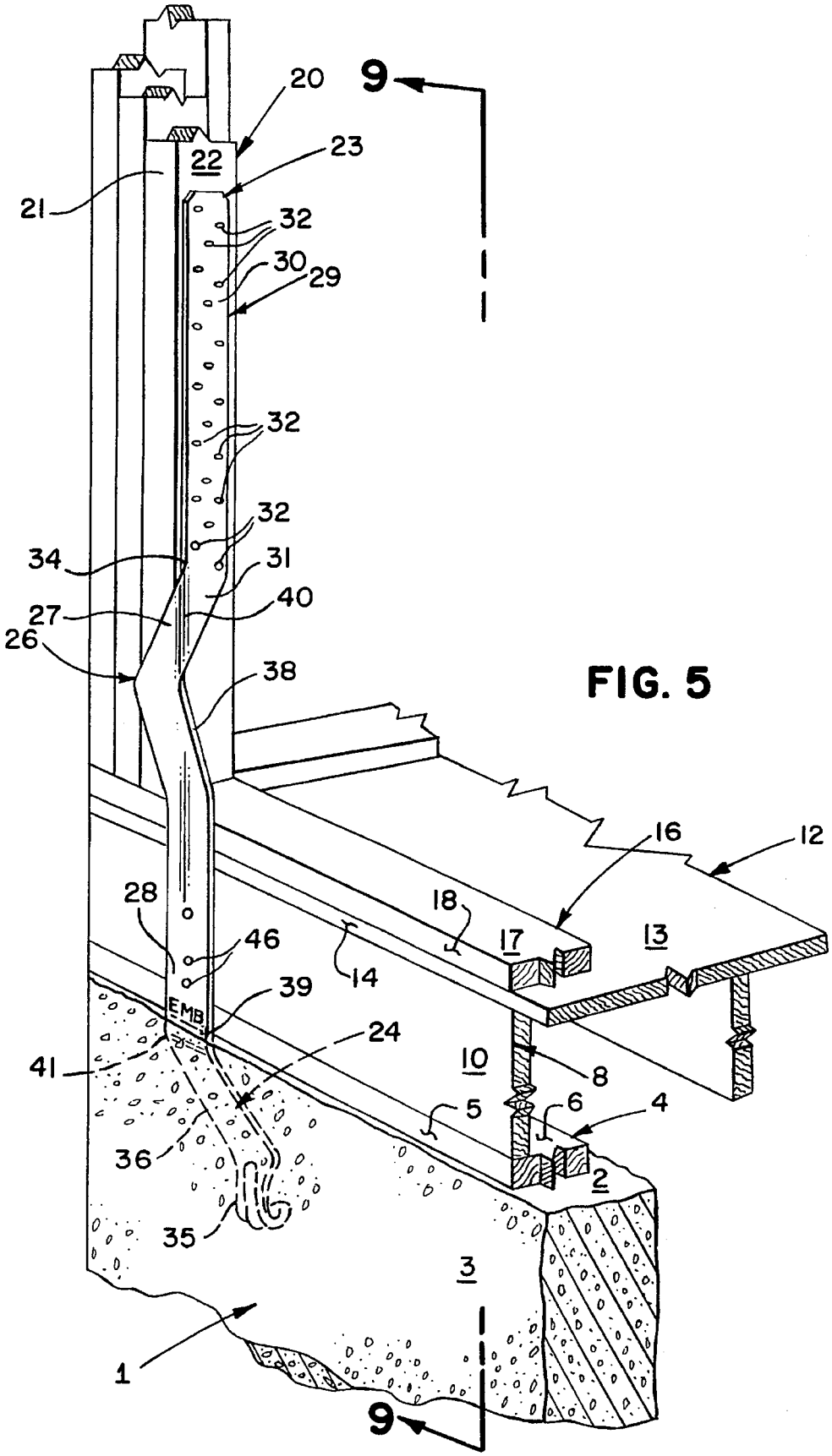
FIG. 5 is a perspective view of another form of the holdown strap connection, including a concrete foundation, a mudsill member, a rim joist member, a subfloor member, a sole plate member and a vertical frame member. The holdown strap connection is shown at a triple 2x left corner with a stem wall foundation. Only a portion of the vertical frame members are shown. Dashed lines show the foot section of the one-piece, in line sheet metal holdown strap connector embedded in the concrete foundation.

The present invention is a holdown strap connection consisting of: a concrete foundation 1 having an upper surface 2 and a side surface 3; a generally horizontally extending mudsill member 4 having an outside edge 5 and an upper side 6 and a lower side 7 resting on the concrete foundation 1; a rim joist member 8 having an upper edge 9, a side 10, and a lower edge 11 resting on the upper side 6 of the mudsill member 4; a subfloor member 12 having an upper face 13, an edge 14, and a lower face 15 resting on the upper edge 9 of the rim joist member 8; a sole plate 16 having an upper side 17, an edge 18 and a lower side 19 resting on the upper face 13 of the subfloor member 12; a generally vertical frame member 20 having an outside edge 21 and a side face 22 and mounted on the upper side 17 of the sole plate 16; a one-piece, in-line sheet metal holdown strap connector 23 including a foot section 24 embedded in the concrete foundation 1, a transition section 26 having an upper portion 27 and a lower portion 28 connected to the foot section 24 and extending from the concrete foundation 1 past the outside edge 5 of the mudsill member 4, along the side 10 of the rim joist 8, along the edge 14 of the subfloor member 12, along the edge 18 of the sole plate 16 and along a portion of the outside edge 21 of the vertical frame member 20, and an elongated strap section 29 with an upper portion 30 and a lower portion 31 integrally connected to the upper portion 27 of the transition section 26, extending and in registration with the side face 22 of the vertical frame member 20 and extending in line with the foot section 24 and formed with a plurality of fastener indicia means 32; and fastener means 33 dimensioned for insertion at the fastener indicia means 32 through the elongated strap section 29 of the one-piece, in-line sheet metal holdown strap connector 23 and into the vertical frame member 20.

The fastener indicia means 32 in the elongated strap section 29 may be etched marks, holes, dimples or any other means for locating where the fastener means 33 are to be inserted through the elongated strap section 29.

In the preferred form of the invention, the lower portion 31 of the elongated strap section 29 of the one-piece, in-line sheet metal holdown strap connector 23 is formed with a lateral offset 34 so that the elongated strap section 29 extends in registration with the side face 22 of the vertical frame member 20 at a selected distance from the outside edge 21 of the vertical frame member 20 to prevent splitting of the vertical frame member 20 by insertion of the fastener means 33 too close to the outside edge 21 when the vertical frame member 20 is made from wood.

In the preferred form of the invention the foot section 24 of the one-piece, in-line sheet metal holdown strap connector 23 is formed with a distal end 35, having an angle for mechanical interlock with the concrete foundation 1, and a main portion 36 integrally connected to the distal end 35 of the foot section 24 and disposed at an angle to the transition section 26.

Figure 10:
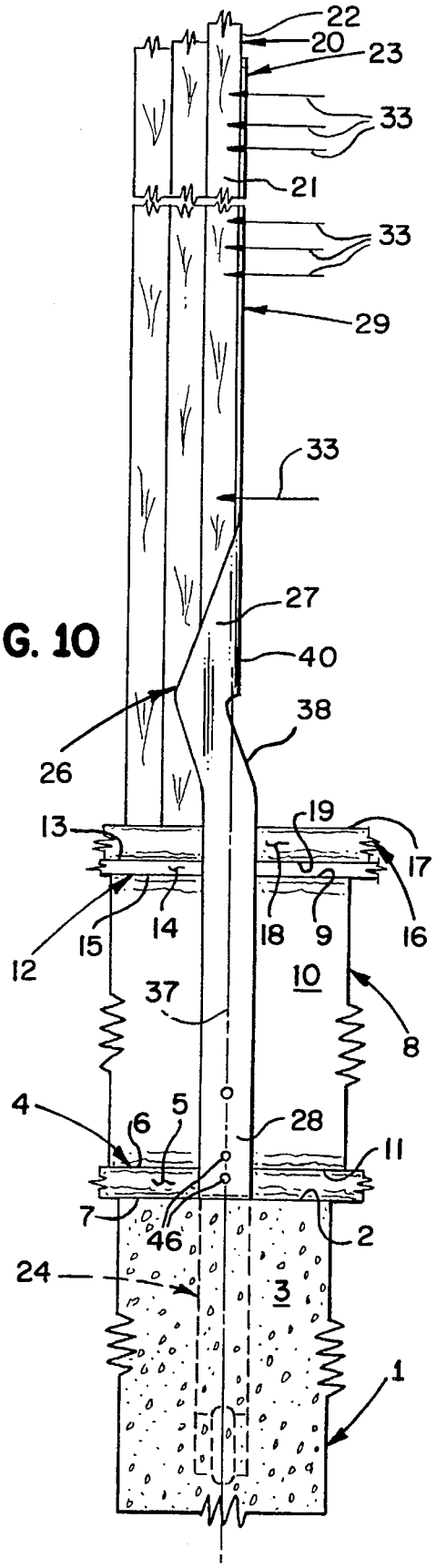
FIG. 10 is a side view of another form of the holdown strap connection taken along line 10—10 of FIG. 9. The vertical frame member is formed from three 2x wood studs. Only portions of the vertical frame members and the concrete foundation are shown. Arrows represent the direction of penetration of the fasteners into the vertical frame member.

More specifically, as shown in FIG. 10, in the preferred form of the invention the centerline 37 of the embedded foot section 24 is substantially in line with the interface of the elongated strap section 29 and the side face 22 of the vertical frame member 20. Placing the center line 37 of the embedded foot section 24 substantially in line with this interface substantially decreases the moment of any uplift force on the embedded foot section 24, because the uplift force on the framed structure is parallel to the elongated strap section 29 and transmitted to the one-piece, in-line sheet metal hold-own strap connector 23 at this interface. Substantial alignment of elongated strap section 29 and the embedded foot section 24 is achieved through the lateral offset means 38 in the transition section 26. The lateral offset means 38 in the transition section 26 isolates the lower portion 28 of the transition section 26 from the upper portion 27 of the transition section 26 and the elongated strap section 29 so that the one-piece, in-line sheet metal holdown strap connector 23 can be bent along bend line 40, which is substantially in line with center line 37 of the foot section 24, or a twist can be started at bend line 40, but only the elongated strap section 29 of the one-piece, in-line sheet metal hold-own strap connector 23 is affected.

The aforesaid description refers to all of the drawings, but the numbering system refers especially to the form of the invention illustrated in FIGS. 2, 5, 6, 9, 10 and 13. The form of the invention illustrated in FIGS. 1, 3, 4, 7, 8, 11, 12 and 14 is identical to the invention in FIGS. 2, 5, 6, 9, 10 and 13 except that the transition section 26 is shorter for installations where the transition section need only span a mudsill member 4. Like or identical parts have been given identical numbers but with the addition of the symbol (').

A modified form of the holdown strap connection illustrated in FIGS. 1, 3, 4, 7, 8, 11, 12 and 14 consists of: a concrete foundation 1' having an upper surface 2' and a side surface 3'; a generally horizontally extending mudsill member 4' having an outside edge 5' and an upper side 6' and a lower side 7' resting on the concrete foundation 1';a generally vertical frame member 20' having an outside edge 21' and a side face 22' and mounted on the upper side 6' of the mudsill member 4'; a one-piece, in-line sheet metal holdown strap connector 23' including, a foot section 24' embedded in the concrete foundation 1', a transition section 26' having an upper portion 27' and a lower portion 28' connected to the foot section 24' and extending from the concrete foundation 1' past the outside edge 5' of the mudsill member 4' and along a portion of the outside edge 21' of the vertical frame member 20', and an elongated strap section 29' with an upper portion 30' and a lower portion 31' integrally connected to the upper portion 27' of the transition section 26', extending and in registration with the side face 22' of the vertical frame member 20' and extending in line with the foot section 24' and formed with a plurality of fastener indicia means 32'; and fastener means 33' dimensioned for insertion at the fastener indicia means 32' through the elongated strap section 29' of the one-piece, in-line sheet metal holdown strap connector 23' and into the vertical frame member 20'.

The fastener indicia means 32' in the elongated strap section 29' may be etched marks, holes, dimples or any other means for locating where the fastener means 33' are to be inserted through the elongated strap section 29'.

In the modified form of the preferred form of the invention, the lower portion 31' of the elongated strap section 29' of the one-piece, in-line sheet metal holdown strap connector 23' is formed with a lateral offset 34' so that the elongated strap section 29' extends in registration with the side face 22' of the vertical frame member 20' at a selected distance from the outside edge 21' of the vertical frame member 20' to prevent splitting of the vertical frame member 20' by insertion of the fastener means 33' too close to the outside edge 21' when the vertical frame member 20' is made from wood.

In the modified form of the preferred form of the invention the foot section 24' of the one-piece, in-line sheet metal holdown strap connector 23' is formed with a distal end 35', having an angle for mechanical interlock with the concrete foundation 1', and a main portion 36' integrally connected to the distal end 35' of the foot section 24' and disposed at an angle to the transition section 26'.

Figure 8:
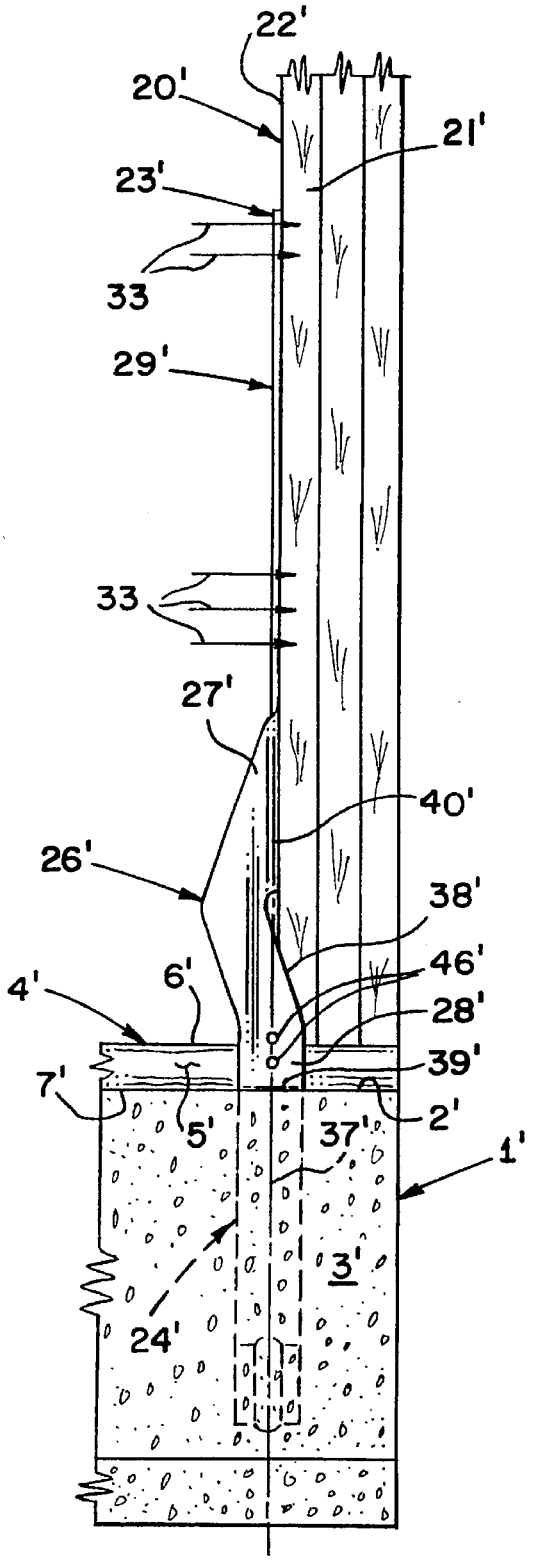
FIG. 8 is a side view of one form of the holdown strap connection taken along line 8—8 of FIG. 7. Only a portion of the vertical frame member is shown. Arrows represent the direction of penetration of the fasteners into the vertical frame member. Dashed lines show the foot section of the one-piece, in line sheet metal holdown strap connector embedded in the concrete foundation.
Figure 9:
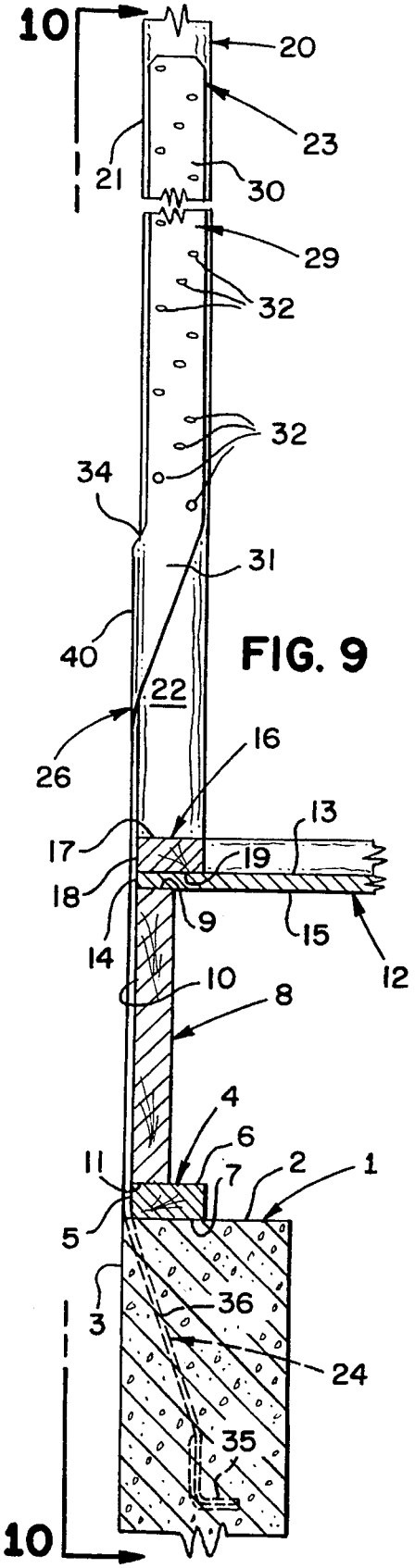
FIG. 9 is an elevated side view of another form of the holdown strap connection taken along line 9—9 of FIG. 5, including a concrete foundation, a mudsill member, a rim joist member, a subfloor member, a sole plate member and a vertical frame member, with a portion removed from the elongated strap section and the vertical frame members so that the connection may be illustrated on one sheet of drawings. The stem wall concrete foundation, the mudsill member, the rim joist member, the subfloor member and the sole plate member are shown in cross section. Only portions of the vertical frame members and the concrete foundation are shown. Dashed lines in the concrete show the foot section of the one-piece, in line sheet metal holdown strap connector embedded in the concrete foundation. The dashed lines at the transition section represent the interface between the outside edge of the vertical frame member and the transition section of the one-piece, in-line sheet metal hold-own strap connector.

More specifically, as shown in FIG. 8, in the modified form of the preferred form of the invention the centerline 37' of the embedded foot section 24' is substantially in line with the interface of the elongated strap section 29' and the side face 22' of the vertical frame member 20'. Placing the center line 37' of the embedded foot section 24' substantially in line with this interface substantially decreases the moment of any uplift force on the embedded foot section 24', because the uplift force on the framed structure is parallel to the elongated strap section 29' and transmitted to the one-piece, in-line sheet metal holdown strap connector 23' at this interface. Substantial alignment of elongated strap section 29' and the embedded foot section 24' is achieved through the lateral offset means 38' in the transition section 26'. The lateral offset means 38' in the transition section 26' isolates the lower portion 28' of the transition section 26' from the upper portion 27' of the transition section 26' and the elongated strap section 29' so that the one-piece, in-line sheet metal holdown strap connector 23' can be bent along bend line 40', which is substantially in line with center line 37' of the foot section 24', or a twist can be started at bend line 40', but only the elongated strap section 29' of the one-piece, in-line sheet metal holdown strap connector 23' is affected.

The holdown strap connection may be made as follows where the one-piece, in-line sheet metal holdown strap connector 23 is to span a rim joist member 8. Form boards are set in place. On the outside concrete form board the location of the side face 22 of the vertical frame member 20 to which the elongated strap section 29 will attach is marked. Next, the main portion 36 of foot section 24 is placed between the form boards in a generally vertical position. The center of the one-piece, in-line sheet metal holdown strap connector 23 is aligned with the mark designating the side face 22 of the vertical frame member 20. The embedment indicia 39 is then aligned with the top of the form board or wherever the upper surface 2 of the concrete foundation 1 will be. Next, the one-piece, in-line sheet metal holdown strap connector 23 is attached to the form board with fasteners. The concrete is then poured between the form boards to form an upper surface 2. The form boards are stripped away, and the one-piece, in-line sheet metal holdown strap connector 23 is aligned to vertical. A mudsill member 4 is placed on surface 2. A rim joist member 8 is attached to the mudsill member 4. A subfloor member 12 is attached to the rim joist member 8. A sole plate 16 is attached to the subfloor member 12. A vertical frame member 20 such as a stud or post is attached to the mudsill with the side face 22 in registration with the elongated strap section 29. Using all the specified fasteners the elongated strap section 29 is attached to the side face 22 of the vertical frame member 20. If steel studs are used as the vertical frame member 20, the elongated strap section 29 should be attached with screws.

Use of the one-piece, in-line sheet metal holdown strap connector 23' dimensioned to span only a mudsill member 4' is similar to the installation of the one-piece, in-line sheet metal holdown strap connector 23 dimensioned to span a rim joist member 8 described immediately above and is not repeated.

The one-piece, in-line sheet metal holdown strap connector 23 may be made from 12 gauge galvanized steel on a progressive die to form blanks. To form the one-piece, in-line sheet metal holdown strap connector 23 from the blank, a 90° bend up is made along bend line 40. An 18° bend up is made along bend line 41 and an 18° bend down is made along bend line 42. A 90° bend up is then made along bend line 43.

Manufacture of the one-piece, in-line sheet metal holdown strap connector 23' dimensioned to span only a mudsill member 4' is similar to the manufacture of the one-piece, in-line sheet metal holdown strap connector 23 dimensioned to span a rim joist member 8 described immediately above and is not repeated.

Figures 11, 12:
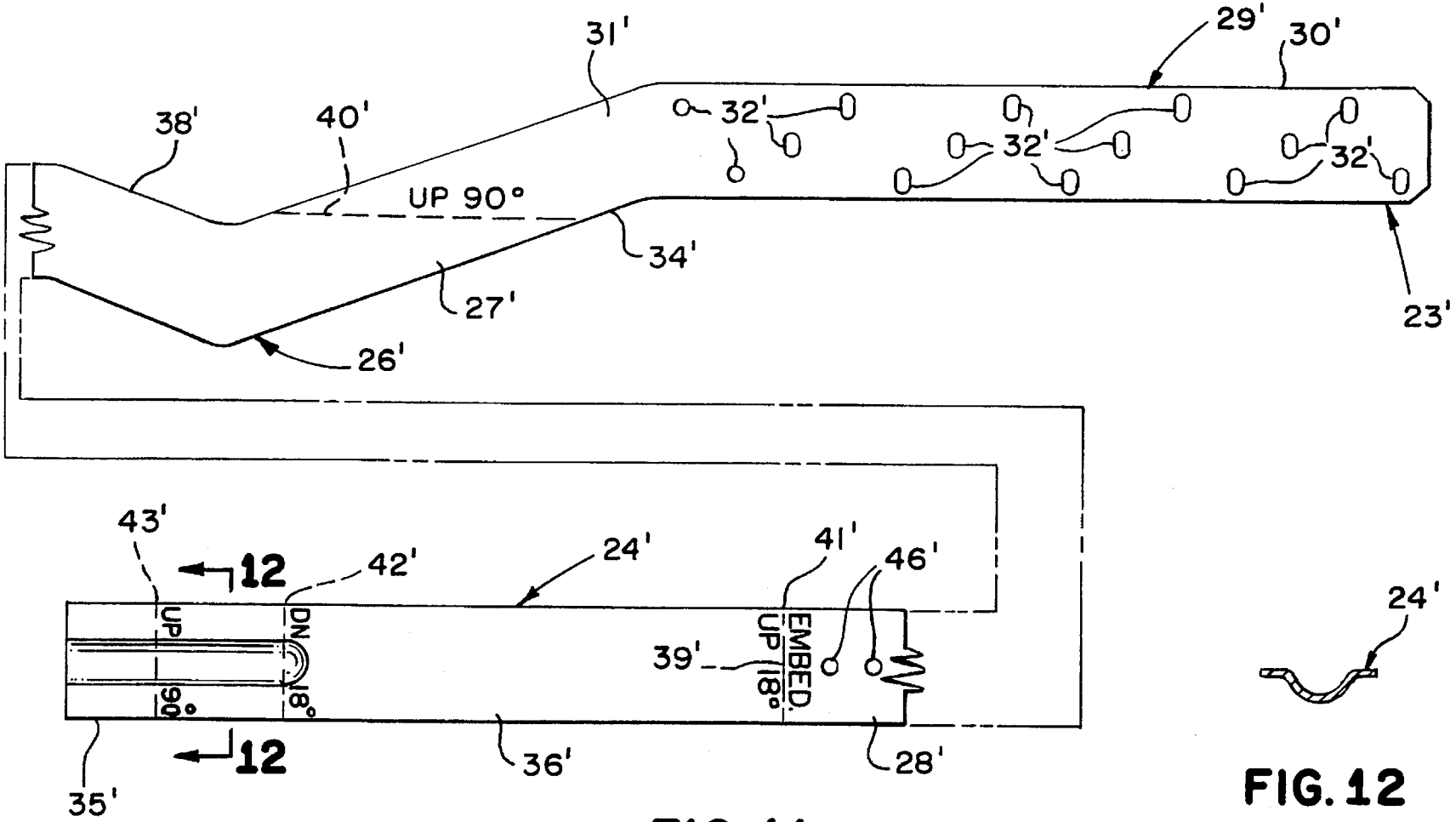
FIG. 11 is a top plan view of the blank of one form of the one-piece, in-line sheet metal strap connector. The blank is shown with a split to illustrate it on one sheet of drawings.
FIG. 12 is a cross sectional view taken along line 12—12 of FIG. 11, showing the embossment in the foot section.
Figure 13:
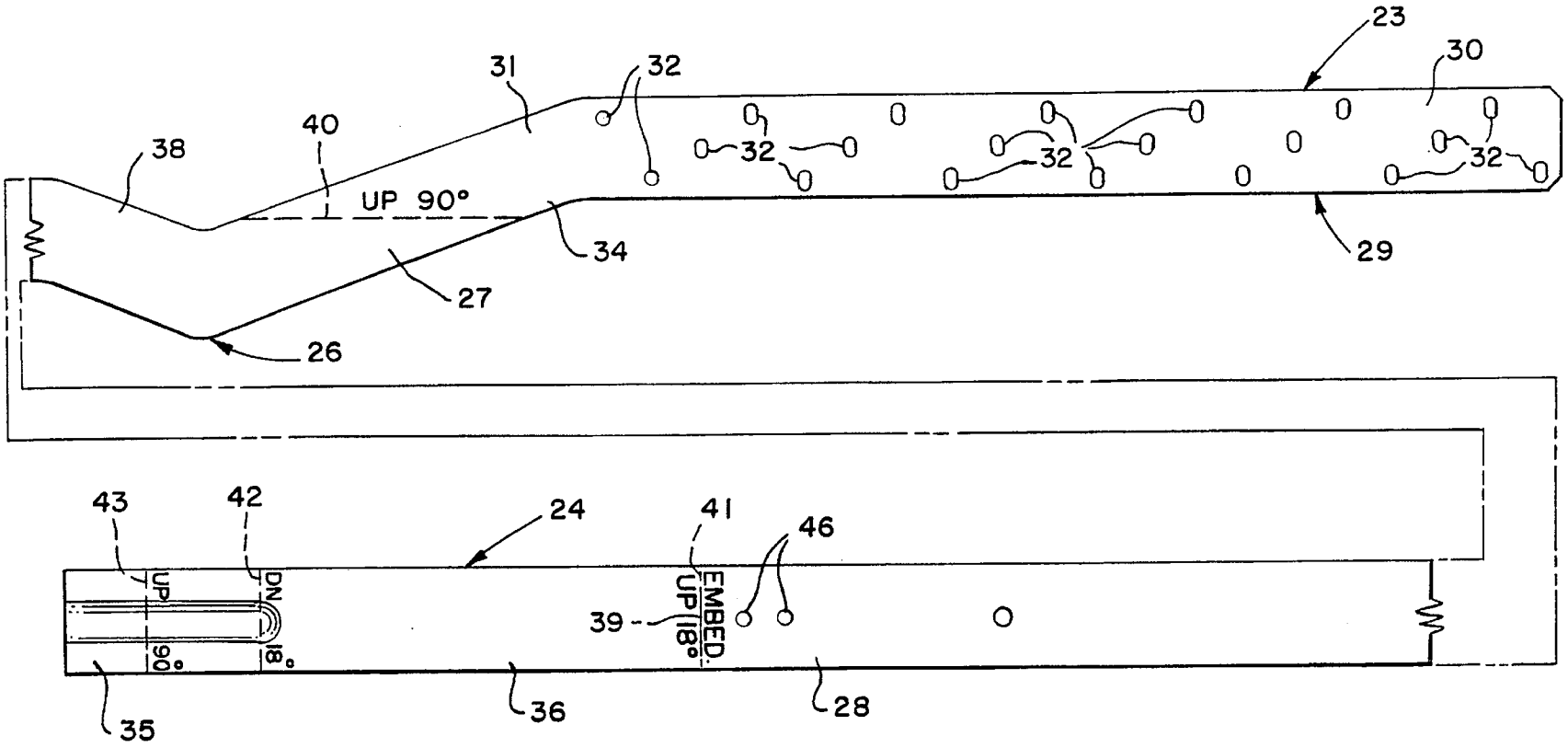
FIG. 13 is a top plan view of the blank of another form of the one-piece, in-line sheet metal holdown strap connector. The blank is shown with a split to illustrate it on one sheet of drawings.

FIGS. 11 & 13 show the forms of the one-piece, in-line sheet metal holdown connectors 23' and 23 made with a 90° bend that brings the elongated strap section out of the plane of the transition section 26' or 26 so that it can attach to the side face 22' or 22 of the vertical frame member 20' or 20. The elongated strap portion 29' or 29 can also be orthogonally displaced from the transition section 26' or 26 by initiating a 90 degree twist in the elongated strap section 29' or 29 at bend line 40' or 40 rather than by bending at bend line 40' or 40.

A form of the one-piece, in-line sheet metal holdown strap connector 23 made from 12 gauge steel that can span a rim joist member 8, receive twenty 16d nail fastener means 33 through its elongated strap section 29, and be embedded approximately 10" into the concrete foundation has a finished length of ⌴¼", is 2" wide and has an estimated weight of 3.47 lbs.

Use of a higher grade of steel in combination with an elongated strap section 29 lengthened to receive more fastener means 33 gives higher load values for the connection's resistance to uplift forces. As an example, a form of the one-piece, in-line sheet metal holdown connector 23 dimensioned to span a rim joist member 8 has a normal load value of 1,645 lbs. when ASTM 446 Grade A steel is used and the elongated strap section's length allows for fourteen 16d nails to be used to attach the elongated strap section 29 to the vertical frame member 20. When the same form of the one-piece, in-line sheet metal holdown connector 23 dimensioned to span a rim joist member 8 is made with ASTM 446 grade C steel and the elongated strap section 29 is lengthened so that twenty **16*d*** nails can be used to make the attachment, the normal load value increases to 2,350 lbs. The above figures are based on testing of a non-corner, wood-to-concrete anchorage in a 6" stem wall of 2000 psi concrete with a minimum #4 rebar installed at the top and bottom of the pour and fastener nail penetration into the wood vertical frame member of 1⅝".

In a preferred form of the invention, fastener indicia means 32 and 32' are formed as obround openings to permit nailing either orthogonally or at a slant angle. Since, however, the greatest stresses occur just above lateral off set portions 34 and 34' it is preferable that the openings in the subject area be round as shown in the drawings to reduce the amount of metal removed.

It is also preferred to form round openings 46 and 46' as shown in the drawings above embedment indicia 39 and 39' to facilitate temporary affixing of one-piece in-line sheet metal holdown strap connector 23 and 23' to form boards (not shown).

Figures 6, 14:
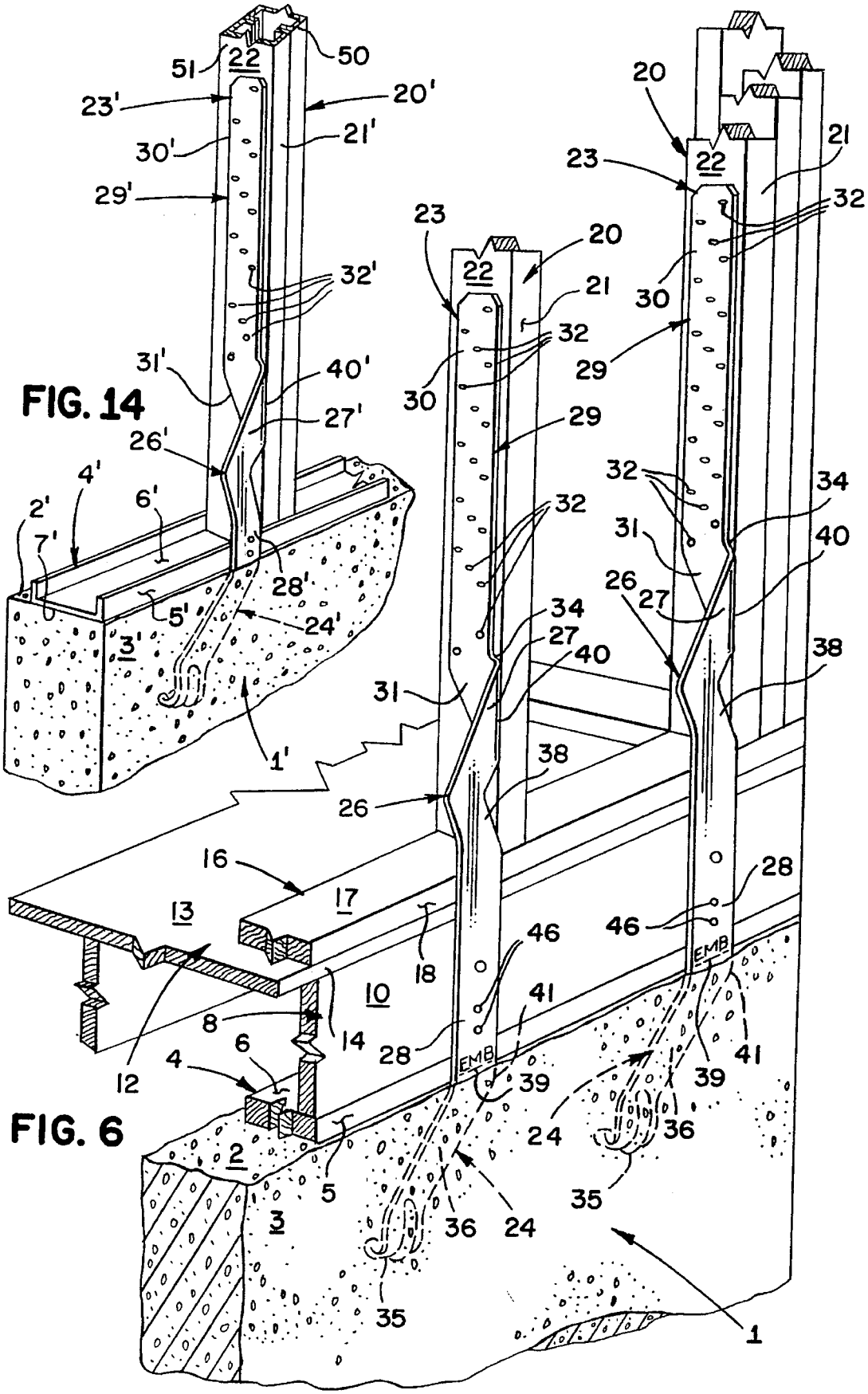
FIG. 6 is a perspective view of another form of the holdown strap connection at two locations, including a concrete foundation, a mudsill member, a rim joist member, a subfloor member, a sole plate member and a vertical frame member. The holdown strap connection is shown away from a corner and at a triple 2x right corner with a concrete stem wall foundation. Only a portion of the vertical frame members are shown. Dashed lines show the foot section of the one-piece, in line sheet metal holdown strap connector embedded in the concrete foundation.
FIG. 14 is a perspective view of one form of the holdown strap connection, including a concrete foundation, a metal mudsill member and a vertical, metal frame member. The holdown strap connection is shown away from a corner. Only portions of the vertical frame members are shown. Dashed lines show the foot section of the one-piece, in-line sheet metal strap connector embedded in the concrete foundation.
Figure 7:
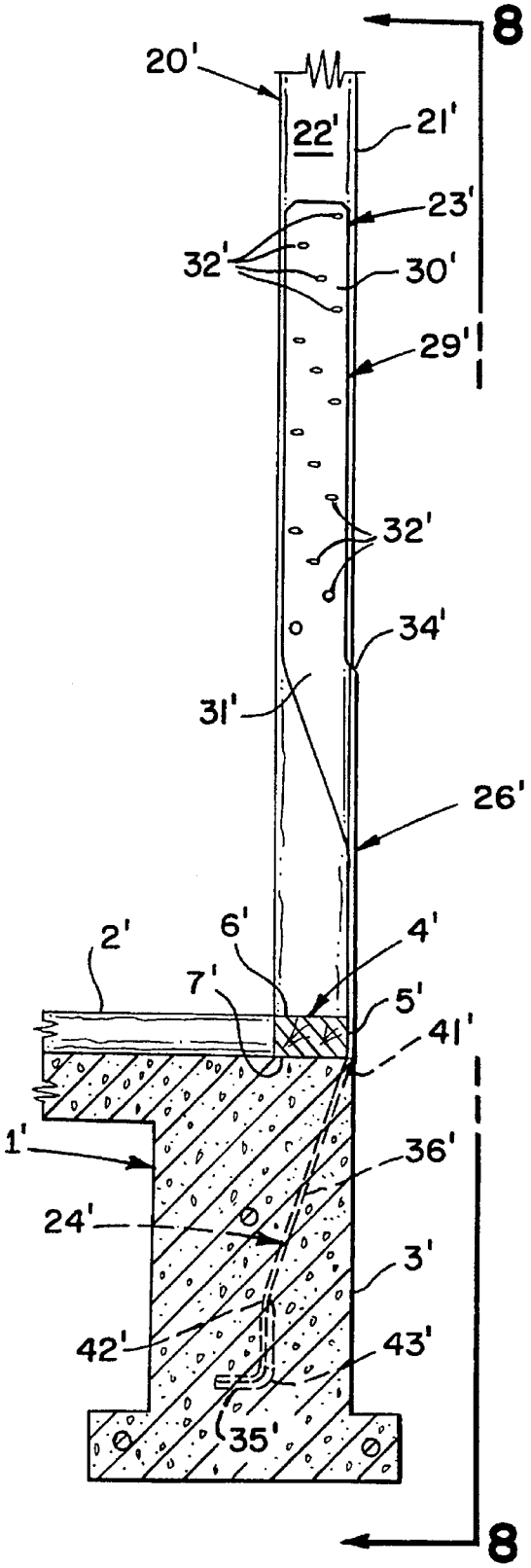
FIG. 7 is side view of one form of the holdown strap connection, including a concrete foundation, a mudsill member and a vertical frame member taken along line 7—7 of FIG. 4. The slab on grade concrete foundation and the wood mudsill member are shown in cross section. Only a portion of the vertical frame member is shown. Dashed lines show the foot section of the one-piece, in line sheet metal holdown strap connector embedded in the concrete foundation.

The modified form of the invention illustrated in FIG. 14 illustrates the use of one piece in-line sheet metal holdown strap connector 23' for holding vertical frame member 20' which is formed from two steel stud members 50 and 51. Screws instead of nail fasteners are used to attach connector 23' to steel stud 50 and 51'.

I claim:

1. A holdown strap connection comprising:

a. a concrete foundation having an upper surface and a side surface;

b. a generally horizontally extending mudsill member having an outside edge and an upper side and a lower side resting on said concrete foundation;

c. a rim joist member having an upper edge, a side, and a lower edge resting on said upper side of said mudsill member;

d. a subfloor member having an upper face, an edge, and a lower face resting on said upper edge of said rim joist member;

e. a sole plate having an upper side, an edge and a lower side resting on said upper face of said subfloor member;

f. a generally vertical frame member having an outside edge and a side face and mounted on said upper side of said sole plate;

g. an elongated sheet metal holdown strap connector including, 1. a foot section embedded in said concrete foundation, 2. a transition section having an upper portion and a lower portion connected to said foot section and extending from said concrete foundation past said outside edge of said mudsill member, along said side of said rim joist, along said edge of said subfloor, along said edge of said sole plate and along a portion of said outside edge of said vertical frame member, and 3. an elongated strap section with an upper portion and a lower portion integrally connected to said upper portion of said transition section, extending and in registration with said side face of said vertical frame member and arranged so that the plane of said elongated strap section generally bisects the plane of said foot section and formed with a plurality of fastener indicia means; and h. fastener means dimensioned for insertion at said fastener indicia means through said elongated strap section of said elongated sheet metal holdown strap connector and into said vertical frame member.

2. A holdown strap connection as described in claim 1, wherein said lower portion of said elongated strap section is formed with a lateral offset means so that said elongated strap section extends in registration with said side face of said vertical frame member at a selected distance from said outside edge of said vertical frame member and said one-piece holdown strap connector may be installed at identical corners of a frame structure having opposite chirality and still provide identical resistance to uplift force.

3. A holdown strap connection as described in claim 1, wherein said foot section comprises:

a. a distal end formed with an angle for mechanical interlock with said concrete foundation; and b. a main portion integrally connected to said distal end of said foot section and disposed at an angle to said transition section.

4. A holdown strap connection comprising:

a. a concrete foundation having an upper surface and a side surface;

b. a generally horizontally extending mudsill member having an outside edge and an upper side and a lower side resting on said concrete foundation;

c. a generally vertical frame member having an outside edge and a side face and mounted on said upper side of said mudsill member;

d. an elongated sheet metal holdown strap connector including, 1. a foot section embedded in said concrete foundation, 2. a transition section having an upper portion and a lower portion connected to said foot section and extending from said concrete foundation past said outside edge of said mudsill member and along a portion of said outside edge of said vertical frame member, and 3. an elongated strap section with an upper portion and a lower portion integrally connected to said upper portion of said transition section, extending and in registration with said side face of said vertical frame member and arranged so that the plane of said elongated strap section generally bisects the plane of said foot section and formed with a plurality of fastener indicia means; and h. fastener means dimensioned for insertion at said fastener indicia means through said elongated strap section of said elongated sheet metal holdown strap connector and into said vertical frame member.

5. A holdown strap connection as described in claim 4, wherein said lower portion of said elongated strap section is formed with a lateral offset means so that said elongated strap section extends in registration with said side face of said vertical frame member at a selected distance from said outside edge of said vertical frame member and said one-piece holdown strap connector may be installed at identical corners of a frame structure having opposite chirality and still provide identical resistance to uplift forces.

6. A holdown strap connection as described in claim 4, wherein said foot section comprises:

a. a distal end formed with an angle for mechanical interlock with said concrete foundation; and b. a main portion integrally connected to said distal end of said foot section and disposed at an angle to said transition section.

* * * * *

UNITED STATES PATENT AND TRADEMARK OFFICE

CERTIFICATE OF CORRECTION

PATENT NO. : 5,595,031

DATED : January 21, 1997

INVENTOR(S) : Alfred D. Commins

It is certified that error appears in the above-identified patent and that said Letters Patent is hereby corrected as shown below:

On the cover sheet after [22] Filed: Aug. 29, 1994 delete the phrase "(Under 37 CFR 1.47)"

Column 4, line 27, change "2B" to ---2x---

Column 9, line 10, change "␣¼"," to ---55-¼"---

Signed and Sealed this

Twenty-seventh Day of May, 1997

*Attest:*

Bruce Lehman

BRUCE LEHMAN

*Attesting Officer*

*Commissioner of Patents and Trademarks*